US011174726B2

(12) United States Patent
Hagen

(10) Patent No.: US 11,174,726 B2
(45) Date of Patent: Nov. 16, 2021

(54) MULTIPLE TUBING-SIDE ANTENNAS OR CASING-SIDE ANTENNAS FOR MAINTAINING COMMUNICATION IN A WELLBORE

(71) Applicant: Halliburton Energy Services, Inc., Houston, TX (US)

(72) Inventor: Trond Hagen, Sandefjord (NO)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/754,210

(22) PCT Filed: Nov. 16, 2017

(86) PCT No.: PCT/US2017/062005

§ 371 (c)(1),
(2) Date: Apr. 7, 2020

(87) PCT Pub. No.: WO2019/099010

PCT Pub. Date: May 23, 2019

(65) Prior Publication Data

US 2020/0270989 A1 Aug. 27, 2020

(51) Int. Cl.

| | |
|---|---|
| ***E21B 47/13*** | (2012.01) |
| ***E21B 17/02*** | (2006.01) |
| ***E21B 41/00*** | (2006.01) |

(52) U.S. Cl.

CPC ..... *E21B 47/13* (2020.05); *E21B 17/028* (2013.01); *E21B 41/0035* (2013.01)

(58) Field of Classification Search

CPC ..... E21B 47/13; E21B 17/028; E21B 41/0035

(Continued)

(56) References Cited

U.S. PATENT DOCUMENTS 5,008,664 A 4/1991 More et al.
8,056,619 B2 11/2011 Patel et al.

(Continued)

FOREIGN PATENT DOCUMENTS

WO 2016167777 10/2016

OTHER PUBLICATIONS

International Application No. PCT/US2017/062005, "International Search Report and Written Opinion", dated Aug. 2, 2018, 22 pages.

*Primary Examiner* — Fabricio R Murillo Garcia
(74) *Attorney, Agent, or Firm* — Kilpatrick Townsend & Stockton LLP

(57) ABSTRACT

A tubing string can be at a first position in a wellbore and can move to a second position in the wellbore with respect to a casing string. The tubing string can include a first tubing-side antenna and a second tubing-side antenna coupled at different locations on the tubing string. The first tubing-side antenna can communicatively couple to a casing-side antenna when the tubing string is at the first position in the wellbore, and can be out of communication range with the casing-side antenna when the tubing string is at the second position. The second tubing-side antenna can be coupled at a second location that is spaced a distance from the first location on the tubing string such that the second tubing-side antenna communicatively couples to the casing-side antenna when the tubing string is at the second position.

20 Claims, 8 Drawing Sheets

(58) Field of Classification Search
USPC ..... 340/853.2
See application file for complete search history.

(56) References Cited

U.S. PATENT DOCUMENTS

| | | | | |
|---|---|---|---|---|
| 8,689,621 | B2 | 4/2014 | Godager et al. | |
| 9,175,523 | B2 | 11/2015 | Patel et al. | |
| 2009/0066535 | A1 | 3/2009 | Patel et al. | |
| 2010/0165788 | A1 | 7/2010 | Rayssiguier et al. | |
| 2011/0030946 | A1* | 2/2011 | Upshall | E21B 47/13 166/248 |
| 2011/0163890 | A1* | 7/2011 | Bowles | E21B 17/028 340/854.8 |
| 2012/0024050 | A1 | 2/2012 | Godager et al. | |
| 2012/0043069 | A1 | 2/2012 | Maranuk et al. | |
| 2012/0168228 | A1* | 7/2012 | Giroux | E21B 21/103 175/57 |
| 2014/0174732 | A1* | 6/2014 | Goodwin | E21B 47/01 166/255.1 |
| 2015/0275657 | A1 | 10/2015 | Deffenbaugh et al. | |
| 2018/0142529 | A1* | 5/2018 | MacDonald | E21B 33/128 |
| 2018/0266238 | A1* | 9/2018 | Livescu | E21B 47/12 |
| 2019/0203582 | A1* | 7/2019 | Jarvis | G01K 7/01 |

* cited by examiner

MULTIPLE TUBING-SIDE ANTENNAS OR CASING-SIDE ANTENNAS FOR MAINTAINING COMMUNICATION IN A WELLBORE

TECHNICAL FIELD

The present disclosure relates to communicating with sensors in a wellbore. More specifically, but not by way of limitation, this disclosure relates to multiple tubing-side antennas or casing-side antennas for maintaining communication with a casing-side sensor in a wellbore.

BACKGROUND

A well (e.g., an oil or gas well for extracting fluid or gas from a subterranean formation) can include a casing string or a casing liner defining a wellbore. Various sensors including various actuators (e.g., any electronic or electromechanical devices for measuring characteristics of the subterranean formation) can be coupled to the casing string and can be referred to as casing-side sensors. In some examples, the casing-side sensors are positioned on an outer surface of the casing string. The position of the casing-side sensor can improve the accuracy of measurements obtained by the casing-side sensor. But, the position of the casing-side sensor can also present challenges for communicating the measurements to well operators at the surface, such as when a tubing string with an antenna that communicates with the casing-side sensor changes position. In additional or alternative examples, various intermediate casings can separate the casing-side senor from the tubing string.

DETAILED DESCRIPTION

Figure 1:
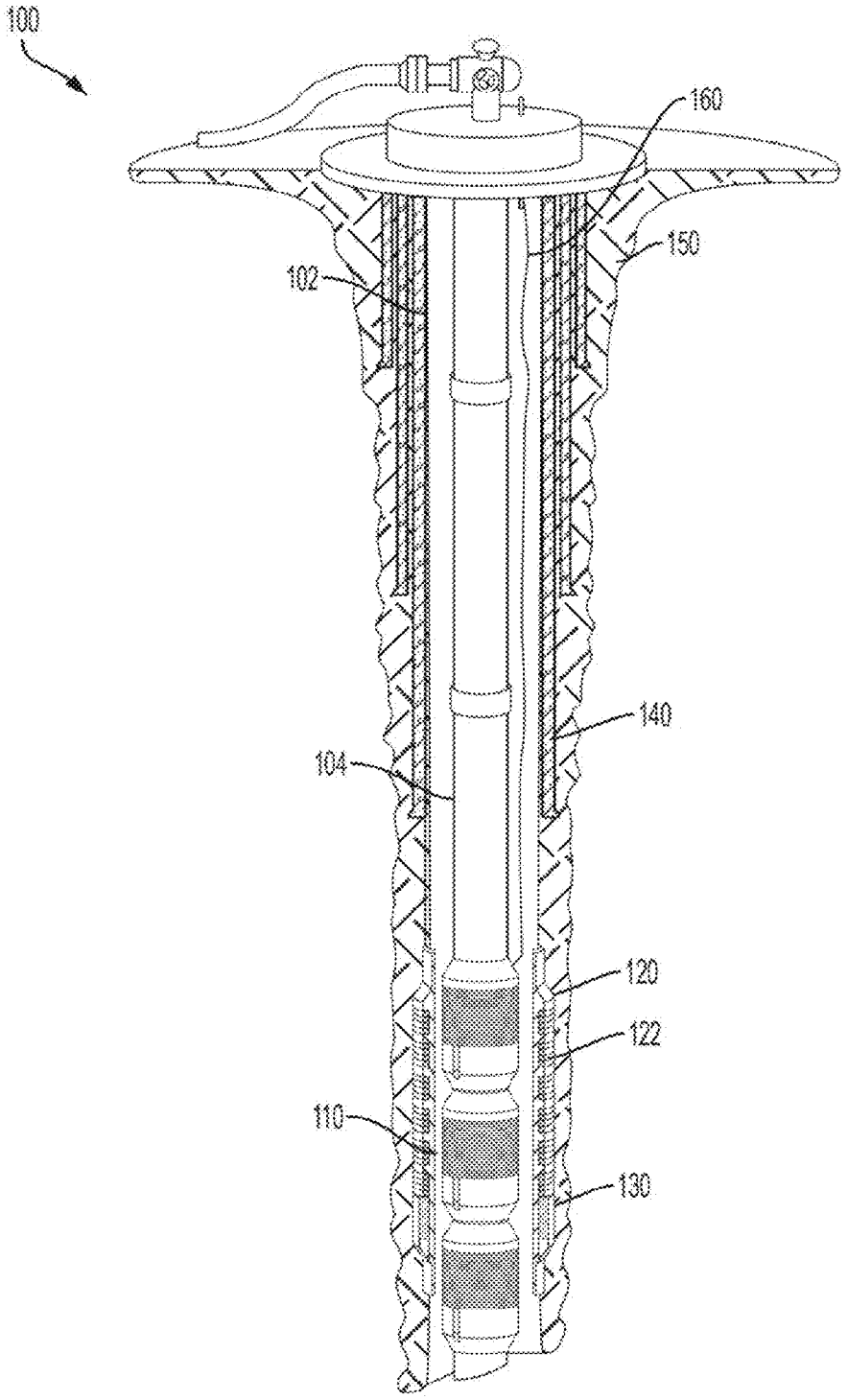
FIG. 1 is a diagram of an example of a well including a tubing string with multiple tubing-side antennas coupled thereto and multiple casing-side antennas for maintaining communication with a casing-side sensor according to one aspect of the present disclosure.

Certain aspects and features relate to multiple tubing-side antennas or casing-side antennas for maintaining communication with a casing-side sensor in a wellbore. Maintaining communication with a casing-side sensor can include preserving a path for communicating data signals for transferring data or communicating power signals for transferring power. In some examples, a casing-side sensor can be coupled to a casing-side antenna stack. A casing-side sensor can include an actuator or any suitable electrical or electromechanical device for wirelessly transmitting data (e.g., measurements representing characteristics of a subterranean formation) obtained by the casing-side sensor. A tubing string with multiple tubing-side antennas mechanically coupled thereto can be positioned in the wellbore such that a tubing-side antenna is within communication range of the casing-side antenna stack. Various forces can shift the position of the tubing string in the wellbore with respect to the casing-side antenna stack such that the tubing-side antenna moves out of communication range with the casing-side antennas stack. Communication with the casing-side antenna stack can be maintained by using another tubing-side antenna positioned along the tubing string that is in communication range of the casing-side antenna when the initial tubing-side antenna moves out of range. Tubing-side antennas within range of the casing-side antenna stack can transfer power, transmit instructions, or receive data representing measurements from the casing-side antenna stack. In additional or alternative examples, the tubing-side antennas can be positioned such that more than one tubing-side antenna remains in communication range with the casing-side antenna stack providing communication redundancy between the casing-side antenna stack and the tubing-side antennas.

In additional or alternative examples, multiple casing-side antennas can be included in the casing-side stack for extending alignment beyond the practical maximum length of the tubing-side stack of antennas. A casing-side antenna can be positioned along the casing string such that the casing-side antenna is in communication range of the tubing-side antenna stack when another casing-side antenna moves out of range of the tubing-side antenna stack. In additional or alternative examples, the casing-side antennas can be positioned such that more than one casing-side antenna remains in communication range with the tubing-side antenna stack and provides communication redundancy between the casing-side antennas and the tubing-side antenna stack.

Examples of forces that can shift the tubing string include changes in temperature, pressure, or fluid flow in a wellbore that cause a tubing string coupled to a hanger to shift a distance, which may be more than 6 meters. In addition or alternatively, the initial space out of the tubing string can result in the relative position of the tubing-side antennas and casing-side antennas being uncertain due to tolerances in measured joint lengths and varying tubing, casing, and drill pipe cross sections. The relative positon of the tubing-side antennas and casing-side antennas can also be uncertain due to wall-to-casing friction, casing-to-tubing friction, buoyancy in the wellbore, and other effects causing tubing strings to compress or stretch. Using multiple tubing-side antennas or casing-side antennas can increase the alignment distance, or the distance that the tubing string is positioned from an alignment with the casing-side antenna stack without losing communication with the casing-side sensor. In some aspects, using multiple tubing-side antennas can also reduce costs by reducing the number of casing-side antennas, which can use more material and more expensive material. In additional or alternative aspects, using multiple tubing-side antennas can also be more reliable since tubing-side antennas are exposed to fewer forces for less time than casing-side antennas.

Two or more tubing-side antennas positioned a predetermined distance apart on a tubing string or two or more casing-side antennas positioned a predetermined distance apart on a casing string can operate as alignment-extension antennas. Alignment-extension antennas can increase the range of positions at which a tubing string can be positioned (or shifted to) in a wellbore and maintain communication with a casing-side sensor. Additional antennas can be positioned between the alignment-extension antennas and operate as redundant antennas. In some examples, redundant tubing-side antennas can provide an alternate communication path with a casing-side antenna stack, which can be used if an alignment-extension tubing-side antenna, a casing-side antenna, or their corresponding electronics fails.

In some aspects, a casing-side antenna can include conductive wire wrapped in a coil around the casing string. Using multiple casing-side antennas as alignment-extension and redundancy antennas can reduce alignment costs and increase reliability. In some aspects, tubing-side antennas can include conductive wire wrapped in a coil around the tubing string, which can be cheaper to manufacture than casing-side antennas. The cost of one additional antenna on the tubing side can be far less than the cost of 10-20 additional antennas on the casing side. In additional or alternative aspects, the carrier and antenna encapsulation used for casing-side antennas can be more expensive. The tubing-side antenna assembly can use less material due to a smaller outer diameter of the tubing string compared to the casing string. The tubing-side antennas can also use less expensive materials than the casing-side antennas, which may be made of low conductivity materials, non-magnetic materials, or both low conductivity and non-magnetic materials that are expensive to purchase and machine. In some aspects, the tubing string may be manufactured as a single unit with more than one tubing-side antenna. In additional or alternative aspects, the tubing string may be manufactured as separate and independent sections. In some examples, one extra tubing-side antenna can double the alignment length of the system without making the expensive casing-side antenna stack longer.

In some aspects, a computing device for analyzing the data can be positioned at a surface of the wellbore and can be communicatively coupled to the tubing-side antennas by a cable extending into the wellbore. The tubing-side antennas can receive the data from the casing-side antenna stack and electronics communicatively coupled to the tubing-side antennas can transmit the data to the computing device. Using multiple tubing-side antennas can maintain communication between the casing-side sensor and the computing device, which can provide wellbore operators with more data and models about conditions in the subterranean formation through which the wellbore is formed.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

FIG. 1 is a schematic diagram of an example of a well 100 including a tubing string 104 having multiple tubing-side antennas 110 for maintaining communication with a casing-side sensor 130. The well 100 can include a wellbore 102 formed through a subterranean formation 150. The wellbore 102 include a casing string 140 that includes (or is coupled to) the casing-side sensor 130. A casing-side antenna stack 120 including casing-side antennas 122 is communicatively coupled to the casing-side sensor 130 and included in (or physically coupled to) the casing string 140. A cable 160 extends from a surface of the wellbore 102 and communicatively couples to the tubing-side antennas 110.

In this example, the tubing string 104 uses three tubing-side antennas 110 to maintain communication with the casing-side sensor 130 despite shifts in the position of the tubing string 104 within the wellbore 102 relative to the casing string 140. In additional or alternative examples, two tubing-side antennas, or more than three tubing-side antennas, can be included in, or positioned on, a tubing string. Although the well 100 is described herein as including multiple tubing-side antennas 110 for maintaining communication, other implementations are possible. For example, the casing-side antenna stack 120 can include multiple casing-side antennas 122 performing as alignment-extension antennas and redundancy antennas to maintain communication. The tubing string 104 is in a first position in the wellbore 102 in which one or more of the tubing-side antennas 110 are aligned with the casing-side antenna stack 120. Aligned with the casing-side antenna stack 120 can include one of the tubing-side antennas 110 being within range of one of the casing-side antennas 122 for communicating with the casing-side antenna stack 120, even if the one tubing-side antenna of the tubing-side antennas 110 is not physically aligned at the exact same radial position as the one casing-side antenna of the casing-side antennas 122. Since the tubing string 104 has multiple tubing-side antennas 110, the tubing string 104 can maintain communication between tubing-side antennas 110 and the casing-side sensor 130 despite the tubing string 104 shifting a distance of n times the total length of the casing-side antenna stack 120 from alignment, where n is the number of alignment-extension tubing-side antennas physically coupled to the tubing string 104. In this example, the upper and lower tubing-side antennas 110 are alignment-extension tubing-side antennas and the middle tubing-side antenna 110 is a redundancy tubing-side antenna.

In this example, the upper and mid tubing-side antennas 110 are within communication range of the casing-side antenna stack 120. If one of the upper or mid tubing-side antennas 110 fail, the other can maintain communication with the casing-side antenna stack 120. The lower tubing-side antenna 110 is out of communication range of the casing-side antenna stack 120 and may not communicate with the casing-side antenna stack 120 when the tubing string 104 is at the current position.

The tubing string 104 can move in any direction in response to changes in pressure, temperature, or fluid flowing through the tubing string 104. For example, the tubing string 104 can respond to a change in temperature by shifting towards a surface of the wellbore 102 or away from the surface of the wellbore 102 to another position. In one example, if the tubing string 104 shifts a distance up that is equal to the height of one of the tubing-side antennas 110, the role of the upper and lower tubing-side antennas 110 can swap and redundancy can still be made available by the mid tubing-side antenna 110. In other examples, if the tubing string 104 shifts a distance in any direction that results in one of the tubing-side antenna 110 to be out of range of the casing-side antenna stack 120, another one of the tubing-side antennas 110 can move into range of the casing-side antenna stack 120. In some aspects, communication between the tubing-side antennas 110 and the casing-side antenna stack 120 can be maintained in response to the tubing string 104 shifting even farther. For example, when the middle tubing-side antenna 110 and one of the other tubing-side antennas 110 are out of range, the remaining tubing-side antenna 110 can still be in communication with the casing-side sensor 130 via the casing-side antenna stack 120 even without a redundant tubing-side antenna.

Although the wellbore 102 is depicted as a single vertical wellbore, other implementations are possible. For example, the tubing string 104 can be used in a wellbore including a deviated or horizontal portion. In some aspects, multiple casing-side sensors are used at various positions in a casing string. Each casing-side sensor can be communicatively coupled to a separate casing-side antenna stack.

Figure 2:
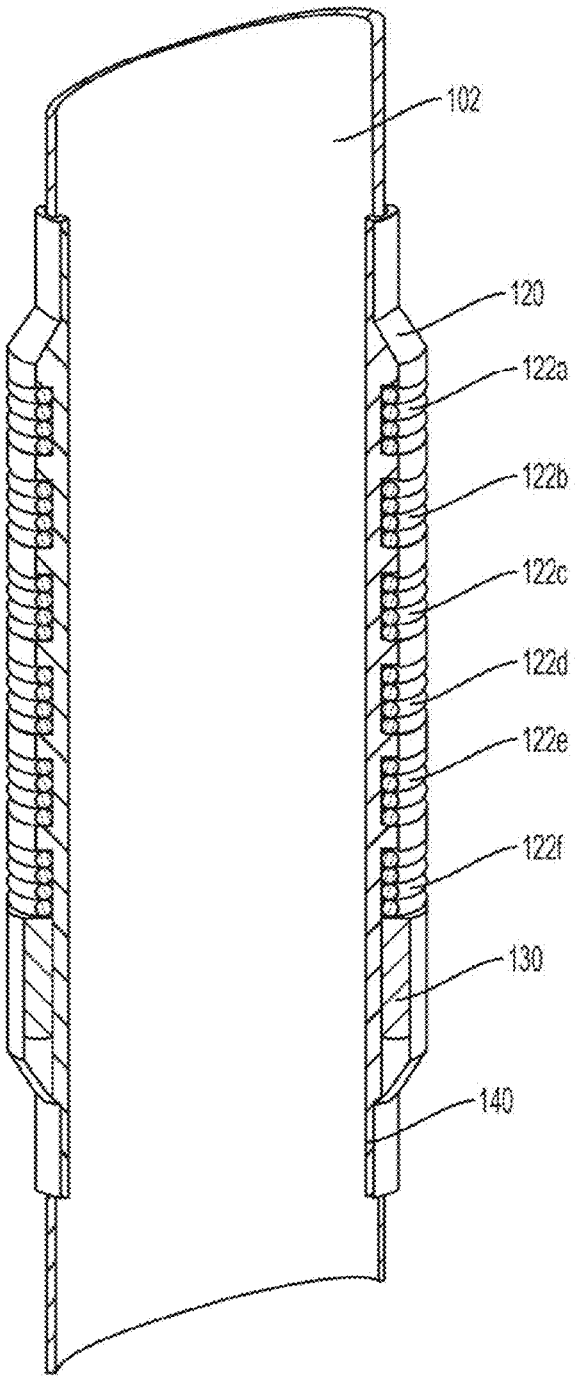
FIG. 2 is a cross-sectional diagram of an example of a casing string with multiple casing-side antennas according to one aspect of the present disclosure.

FIG. 2 is a cross-sectional diagram of an example of the casing string 140 in FIG. 1. The casing string 140 partially defines wellbore 102 and includes the casing-side antenna stack 120 and the casing-side sensor 130. In this example, the casing-side antenna stack 120 can include casing-side antennas 122*a-f*. In other examples, any number of casing-side antennas can be included in the casing-side antenna stack 120. The casing-side antennas 122*a-f* can include conductive wire coiled around the casing string 140. In some examples, the casing-side antennas 122*a-f* include low conductivity non-magnetic materials. In some aspects, the casing-side antennas 122*a-f* can be individually encapsulated or wholly encapsulated in non-metallic materials to allow electromagnetic communication with tubing-side antennas. In additional or alternative aspects, a low conductivity non-magnetic carrier or mandrel can be used for allowing low-loss communication of data and power between the casing-side antennas 122*a-f* and the tubing-side antennas 110*a-c*. The casing-side sensor 130 can include any suitable sensor for measuring characteristics of the subterranean formation or the wellbore 102. For example, the casing-side sensor can include one or more pressure sensors or temperature sensors, but other types of sensors or actuators can be used. In some examples, the casing-side sensor 130 can include shielding for protecting the sensors from electromagnetic fields generated by the antennas or positioned remotely from the antennas.

Although FIGS. 1-2 depict the casing string 140 with a single casing-side antenna stack 120, a single casing-side sensor 130, and six casing-side antennas 122*a-f*, any number of casing-side components can be included in a casing string. For example, a casing string can include more than one casing-side antenna stack, which can each include one or more casing-side antennas and casing-side sensors. In some aspects, a casing-side component can be positioned on an inner surface of a casing string or embedded in the casing string.

Figure 3:
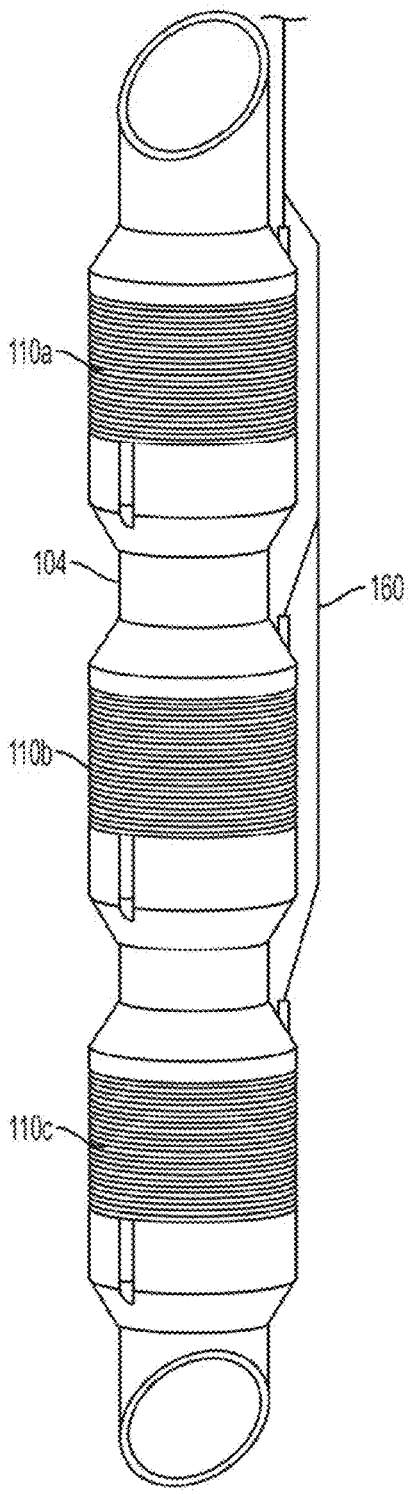
FIG. 3 is a side view of an example of a tubing string with multiple tubing-side antennas according to one aspect of the present disclosure.

FIG. 3 is a side view of an example of the tubing string 104 that includes tubing-side antennas 110*a-c*. The cable 160 can communicatively couple each of the tubing-side antenna 110*a-c* to a computing device for analyzing data measured by a casing-side sensor. Two or more of the tubing-side antennas 110*a-c* can be alignment-extension tubing-side antennas for maintaining communication with a casing-side antenna stack. Additional tubing-side antennas can be positioned between the alignment-extension tubing-side antennas for providing redundancy. In this example, tubing-side antenna 110*a*, 110*c* can be alignment-extension tubing-side antennas and tubing-side antenna 110*b* can be a redundant tubing-side antenna. By separating the alignment-extension tubing-side antennas by a distance based on a length of a casing-side antenna stack, an alignment length of the tubing string 104 can be increased. The alignment length is a range of positions at which the tubing string 104 can be positioned and still maintain communication with a casing-side antenna stack.

In some examples, the alignment length is predetermined and two or more tubing-side antennas are used for alignment extension purposes. Additional tubing-side antennas can be added between the two or more tubing side antennas with the extra cost of just the extra tubing side antenna and electronics (e.g., an additional driver and an additional carrier or additional carrier length) without any consequences to the alignment length. In that example, there may not be redundancy at the ends of the alignment length. To obtain redundancy for the full alignment length for an antenna system, the same number of redundant tubing-side antennas as the number of alignment-extension tubing-side antennas may be used.

Although FIGS. 1 and 3 depict the tubing string 104 with three tubing-side antennas 110*a-c* two tubing-side antennas or more than three tubing-side antennas can be included in or positioned on a tubing string. Also, in some examples, one or more of the tubing-side antennas 110*a-c* can be positioned on an inner surface of the tubing string 104 or embedded in the tubing string 104, rather than being conductive wire coiled around an outer surface of the tubing string 104, as shown in FIGS. 1 and 3.

Figure 4:
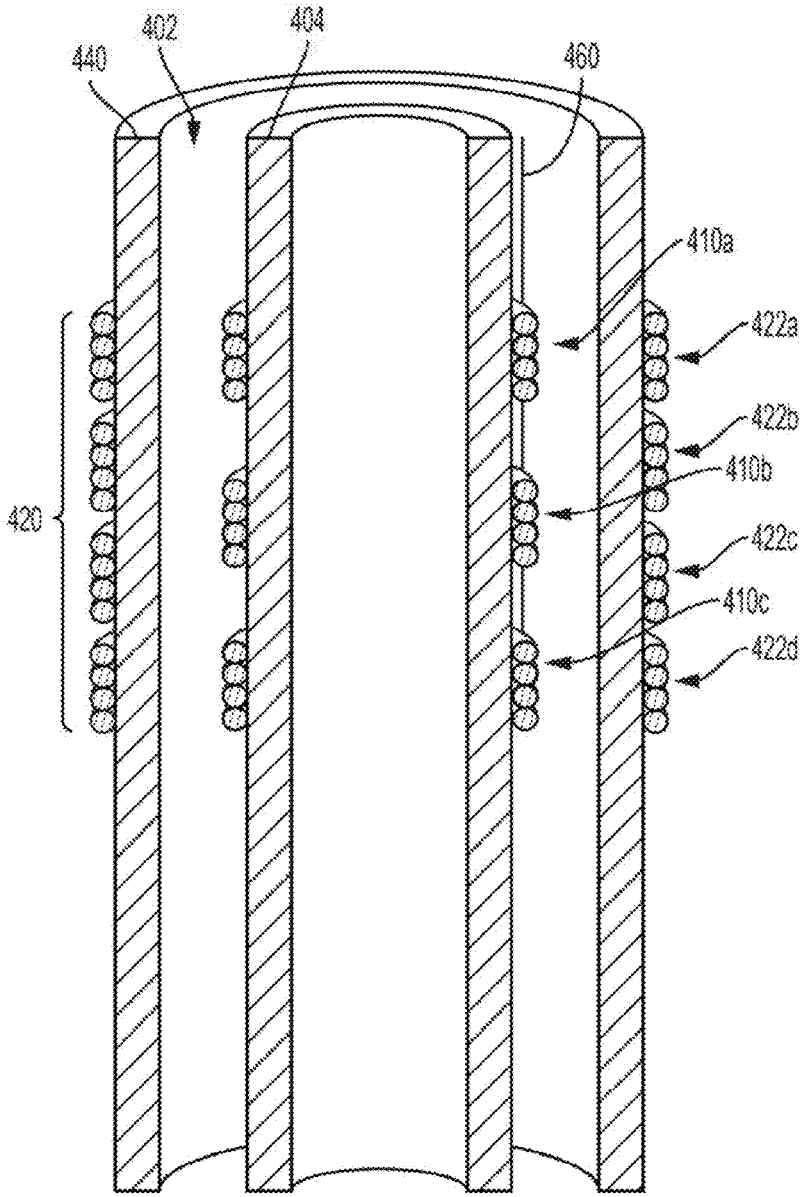
FIG. 4 is a cross-sectional diagram of an example of a tubing string with multiple tubing-side antennas positioned at a first position in a wellbore according to one aspect of the present disclosure.
Figure 5:
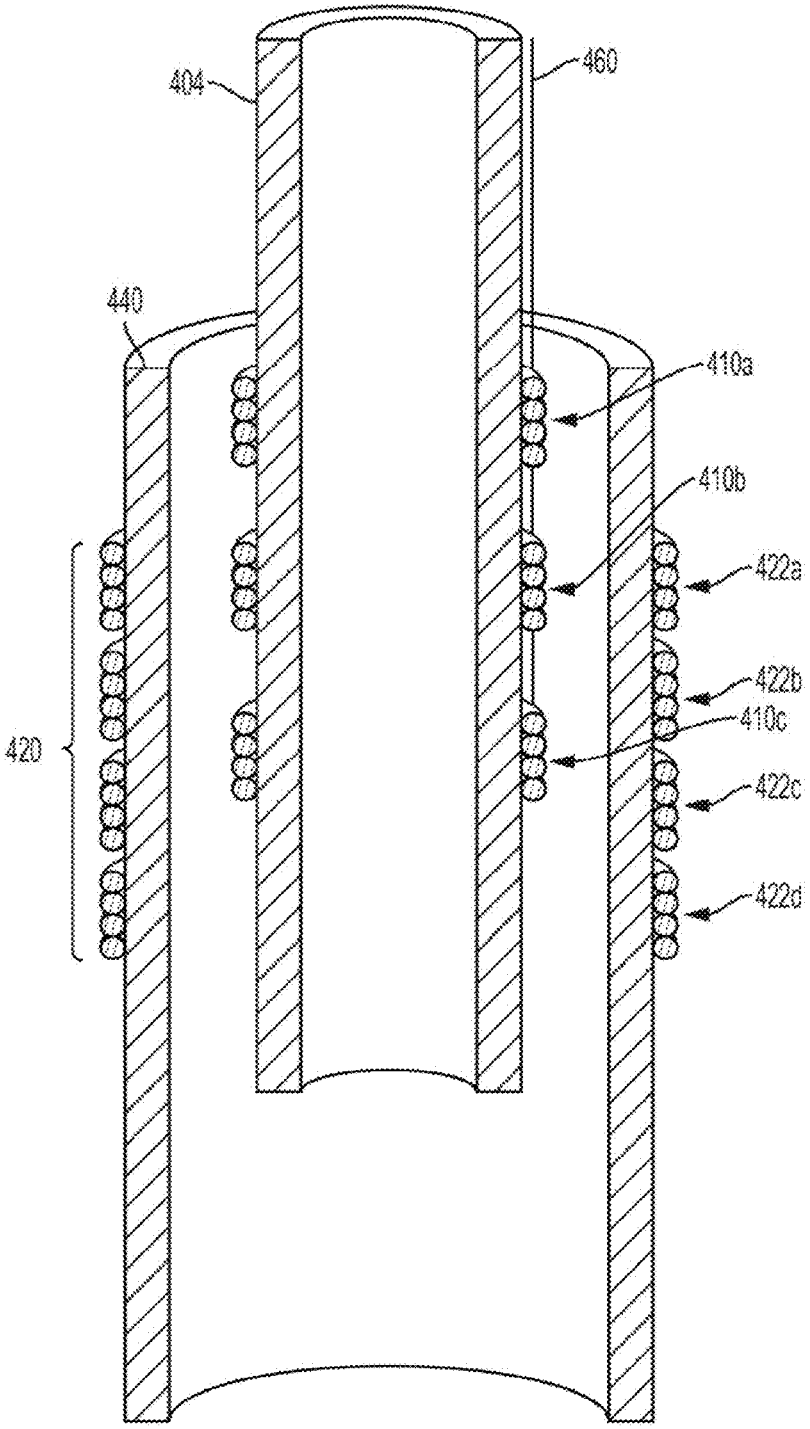
FIG. 5 is a cross-sectional diagram of an example of the tubing string in FIG. 4 positioned at a second position in the wellbore according to one aspect of the present disclosure.

FIGS. 4-5 are cross-sectional diagrams of an example of a tubing string 404 with multiple tubing-side antennas 410*a-c* that is positioned in a wellbore 402 for maintaining communication with a casing-side antenna stack 420. The casing-side antenna stack 420 is coupled to a casing string 440 positioned in the wellbore 402 and includes casing-side antennas 422*a-d*. In this example, the tubing-side antennas 410*a-c* and the casing-side antennas 422*a-d* are depicted as single layer conductive coils with four loops, but any number of layers and loops may be implemented. For example, the tubing-side antennas 410*a-c* can include one or more layers of conductive wire in which a first layer is wrapped around the tubing string 404 and each subsequent layer is wrapped around a previous layer. In some examples, the casing-side antenna stack 420 is coupled to a casing-side sensor (not depicted) that can measure characteristics about a subterranean formation through which the wellbore 402 is formed. The tubing-side antennas 410*a-c* can maintain communication with the casing-side sensor via the casing-side antenna stack 420.

In some examples, the tubing-side antennas 410*a-c* transmit power and instructions to the casing-side sensor. In additional or alternative examples, the tubing-side antennas 410*a-c* receive signals that include data measured by the casing-side sensor from the casing-side antenna stack 420. The tubing-side antennas 410*a-c* are communicatively coupled to a cable 460 that can be communicatively coupled to a computing device (not depicted). The tubing-side antennas 410*a-c* can be communicatively coupled with electronics for transmitting a signal based on the signal received from the casing-side antenna stack 420 to the computing device via the cable 460. In some aspects, the electronics can include additional tubing-side sensors and the signal can include a combination of data representing measurements obtained by a casing-side sensor and data representing measurements obtained by a tubing-side sensor.

In FIG. 4, the tubing string 404 is positioned at a first position in the wellbore 402 defined by casing string 440. In this example, tubing-side antennas 410*a-c* are vertically aligned with the casing-side antenna stack 420 while the tubing string 404 is positioned at the first position. The casing-side antenna stack 420 is depicted with four casing-side antennas 422*a-d*, but any number of casing-side antennas can be included in the casing-side antennas stack 420. In this example, the tubing-side antenna 410*a* and the casing-side antenna stack 420 can be in a plane extending radially from a center of the tubing string 404. In this example, tubing-side antenna 410*a* can be in communication range of casing-side antenna 422*a*, tubing-side antenna 410*b* can be in communication range of casing-side antenna 422*b* or casing-side antenna 422*c*, and tubing-side antenna 410*c* can be in communication range of casing-side antenna 422*d*. In additional or alternative examples, tubing-side antenna 410*a* can be in communication range of a virtual casing-side antenna that includes one or more casing-side antennas (e.g., 422*a-d*). In additional or alternative examples, the tubing-side antenna 410*a* can be a virtual tubing-side antenna that includes one or more physical tubing-side antennas. Communication between a virtual tubing-side antenna and a virtual casing-side antenna can allow a higher rate of power and data transfer with fewer dips than communicating between single physical antennas.

In the example depicted in FIG. 4, the tubing-side antenna 410*b* can be a redundant tubing-side antenna for tubing-side antenna 410*a*, which can be an alignment-extension tubing-side antenna. A redundant tubing-side antenna can provide an alternative communication path for detecting errors or interference between an alignment-extension tubing-side antenna and the casing-side antenna stack 420. An alignment-extension tubing-side antenna can be positioned on the tubing string 404 at a predetermined distance from another alignment-extension tubing-side antenna to maintain communication with the casing-side antenna stack 420 despite movement of the tubing string 404. In this example, tubing-side antenna 410*a* and tubing-side antenna 410*c* are alignment-extension tubing-side antennas. In response to the tubing string 404 shifting towards the surface, tubing-side antenna 410*a* may move out of alignment and out communication range with the casing-side antenna stack 420.

In FIG. 5, the tubing string 404 is positioned at a second position in the wellbore 402. Tubing-side antennas 410*b-c* are vertically aligned with the casing-side antenna stack 420 while the tubing string 404 is positioned at the second position such that tubing-side antennas 410*b-c* and casing-side antenna stack 420 are in a plane extending radially from a center of the tubing string. In this example, tubing-side antenna 410*b* can be in communication range of casing-side antenna 422*a*, and tubing-side antenna 410*c* can be in communication range of casing-side antenna 422*b* or casing-side antenna 422*c*. The tubing-side antenna 410*b* can be a redundant tubing-side antenna for tubing-side antenna 410*c*, which can be an alignment-extension tubing-side antenna.

In some examples, a distance between non-redundant tubing-side antennas (e.g., tubing-side antenna 410*a* and tubing-side antenna 410*c*) can be less than or equal to a length of the casing-side antenna stack 420. The distance can be selected to ensure that as one of the tubing-side antennas 410*a-c* moves out of a communication range of the casing-side antenna stack 420, another one of the tubing-side antennas 410*a-c* moves into the communication range of the casing-side antenna stack 420.

In additional or alternative examples, the tubing string 404 can be held at a position and prevented from shifting more than a predetermined amount. For example, a hanger may be coupled to the tubing string 404 and prevent the tubing string 404 from shifting from an initial position. The number of tubing-side antennas 410*a-c* coupled to the tubing string 404 can be based on the distance between non-redundant tubing-side antennas and the predetermined amount the tubing string 404 is allowed to shift.

Although FIGS. 4-5 depict a casing-side antenna stack with four casing-side antennas 422*a-d*, a casing-side antenna stack can include one or more casing-side antennas. In some aspects, a portion of a casing-side antenna stack can be positioned on an inner surface of the casing string 440 or embedded within the casing string 440. In additional or alternative aspects, some tubing-side antennas can be positioned on an inner surface of the tubing string 404 or embedded within the tubing string 404. In additional or alternative aspects, more than one casing-side antenna stack can be included in a wellbore. In some examples, the tubing string 404 can be shifted even further toward a surface of the wellbore and maintain communication with tubing-side antenna 410*c*, even if redundancy is unavailable.

In some aspects, the casing-side antennas 422*a-d* can be positioned to form alignment-extension casing-side antennas and redundant casing-side antennas. The alignment-extension casing-side antennas can be positioned such that one of the alignment-extension casing-side antennas is within range of a tubing-side antenna as another one of the alignment-extension casing-side antennas moves out of range of the tubing-side antenna. The redundant casing-side antenna can be positioned between the alignment-extension casing-side antennas and offer an alternate communication path.

Figure 6:
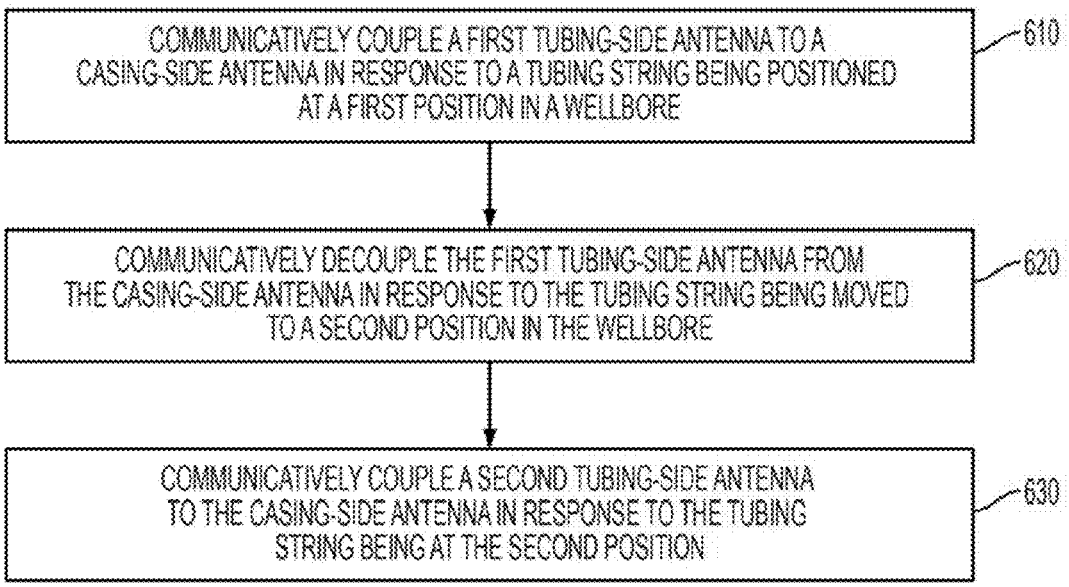
FIG. 6 is a flow chart of an example of a process for maintaining communication with a casing-side sensor in a wellbore using multiple tubing-side antennas according to one aspect of the present disclosure.

FIG. 6 is a flow chart of an example of a process for maintaining communication with a casing-side sensor using in a wellbore using multiple tubing-side antennas. Maintaining communication with a casing-side sensor can provide well operators with more continuous and accurate measurements of subterranean formations through which the wellbore is formed. Well operators can use these measurements to improve the lifespan and production efficiency of the well.

In block 610, a first tubing-side antenna is communicatively coupled to a casing-side antenna in response to a tubing string being positioned at a first position in a wellbore. The wellbore can have a casing string positioned therein and the casing string can include the casing-side antenna. The tubing string can include the first tubing-side antenna coupled at a first location on the tubing string and a second tubing-side antenna coupled at a second location. The first location and the second location can be a predetermined distance apart based on a communication range of the casing-side antenna. In some examples, the first location can be aligned with the tubing-side antenna when the tubing string is in the first position. The first tubing-side antenna positioned at the first location can be within a communication range of the casing-side antenna in response to the first location being aligned with the tubing-side antenna.

In some aspects, the casing string can be in a substantially vertical portion of the wellbore. The tubing string can be positioned at the first position in the wellbore such that the first location of the tubing string and the casing-side antenna are in a plane extending radially from a center of the tubing string.

In block 620, the first tubing-side antenna is decoupled from the casing-side antenna in response to the tubing string being moved to a second position in the wellbore. In some examples, the tubing string can move to the second position in response to a force being applied to the tubing string. The force can be a result of changes in temperature, pressure, or flow rate in the wellbore. The shift to the second position can move the first tubing-side antenna to a position in the wellbore that is out of communication range with the casing-side antenna.

In some aspects, a strength of the signals (e.g., an amplitude of the signal) received by the first tubing-side antenna from the casing-side antenna can be monitored by a computing device. In additional or alternative aspects, a voltage supplied to the casing-side electronics by the first tubing-side antenna can be measured and communicated to the computing device. In some examples, the computing device can determine the first tubing-side antenna is moving out of range of the casing-side antenna based on data representing the strength of the signal received by the first tubing-side antenna or data representing a voltage supplied to the casing-side electronics.

In block 630, the second tubing-side antenna can communicatively couple to the casing-side antenna in response to the tubing string being at the second position. The second tubing-side antenna can maintain communication with the casing-side sensor despite the first tubing-side antenna communicatively decoupling with the casing-side antenna. In some examples, the casing-side electronics may be powered by the first tubing-side antenna and can include a battery (e.g., a rechargeable battery) for powering the casing-side antennas in response to the first tubing-side antenna communicatively decoupling with the casing-side antenna. The second tubing-side antenna can detect a signal transmitted by the casing-side antenna and begin communication with the casing-side antenna. In some aspects, communication with the casing-side antenna can include the second tubing-side antenna transferring power to the casing-side antenna.

In additional or alternative examples, a computing device can detect the second tubing-side antenna is within the communication range of the casing-side antenna and instruct an AC driver to apply an alternating current through the conductive wire of the second tubing-side antenna such that the second tubing-side antenna provides power or communicates instructions to the casing-side antenna and casing-side sensor. In additional or alternative examples, the computing device can instruct the AC driver to apply an alternating current through the conductive wire of all of the tubing-side antennas in response to the tubing string being positioned in the wellbore. Once a communication path with the casing-side sensor is determined using the first tubing-side antenna, the first tubing-side antenna can be used until the first tubing-side antenna moves out of range. The computing device can then check each of the other tubing-side antennas to find a new communication path.

In some aspects, a third tubing-side antenna can communicatively couple to the casing-side antenna in response to the tubing string being in the first position. The third tubing-side antenna can be coupled at a third location on the tubing string that is between the first location and the second location. The third tubing-side antenna can be a redundant antenna for the first tubing-side antenna and provide an alternative communication path with the casing-side antenna when the tubing string is in the first position. The third tubing-side antenna can remain within communication range of the casing-side antenna in response to the tubing string being moved to the second position such that the third tubing-side antenna can be a redundant antenna for the second tubing-side antenna.

In additional or alternative aspects, the process can further include the casing-side sensor measuring characteristics of a subterranean formation through which the wellbore is formed. A casing-side antenna stack that includes the casing-side antenna can transmit data representing the characteristics of the subterranean formation, which can be received by one of the tubing-side antennas. The distance between the first location and the second location on first tubing-side antenna and the second tubing-side antenna can be based on the length of the tubing-side antenna stack. For example, the distance can be less than or equal to the length of the tubing-side antenna stack. The tubing-side antennas can include conductive wire coiled around the tubing string. In some examples, the casing-side antennas can generate an electromagnetic field that can generate a current in the conductive wire of the tubing-side antennas. The changes in current can represent the data. In additional or alternative examples, the tubing-side antennas can transfer power to the casing-side sensor and the casing-side antenna to cause data (e.g., digital information representing certain measurements) to be transmitted back to the tubing-side antenna by loading the magnetic field on the casing side (e.g., short-circuiting the casing-side antennas).

The tubing-side antennas can transmit the data to a computing device at a surface of the wellbore via a cable that extends into the wellbore. The computing device can analyze the data to determine wellbore conditions and determine adjustments to wellbore operations that can extend the lifetime of the well and improve the production efficiency of the well.

Although FIG. 6 depicts a process for maintaining communication in a wellbore using multiple tubing-side antennas, a similar process can be used for maintaining communication in a wellbore using multiple casing-side antennas. For example, the process can include communicatively coupling a first casing-side antenna to a tubing-side antenna in response to a tubing string being positioned at a first position in a wellbore. The first casing-side antenna can be mechanically coupled to a first location along the casing string. The process can further include communicatively decoupling the first casing-side antenna from the tubing-side antenna in response to the tubing string being moved to a second position in the wellbore. The process can further include communicatively coupling a second casing-side antenna to the tubing-side antenna in response to the tubing string being at the second position. The second casing-side antenna can be mechanically coupled to a second location along the casing string. In some aspects, a third casing-side antenna can communicatively couple to the tubing-side antenna in response to the tubing string being in the first position. The third casing-side antenna can be coupled at a third location on the casing string that is between the first location and the second location. The third casing-side antenna can be a redundant antenna for the first casing-side antenna and provide an alternative communication path with the tubing-side antenna when the tubing string is in the first position. The third casing-side antenna can remain within communication range of the tubing-side antenna in response to the tubing string being moved to the second position such that the third casing-side antenna can be a redundant antenna for the second casing-side antenna.

Figure 7:
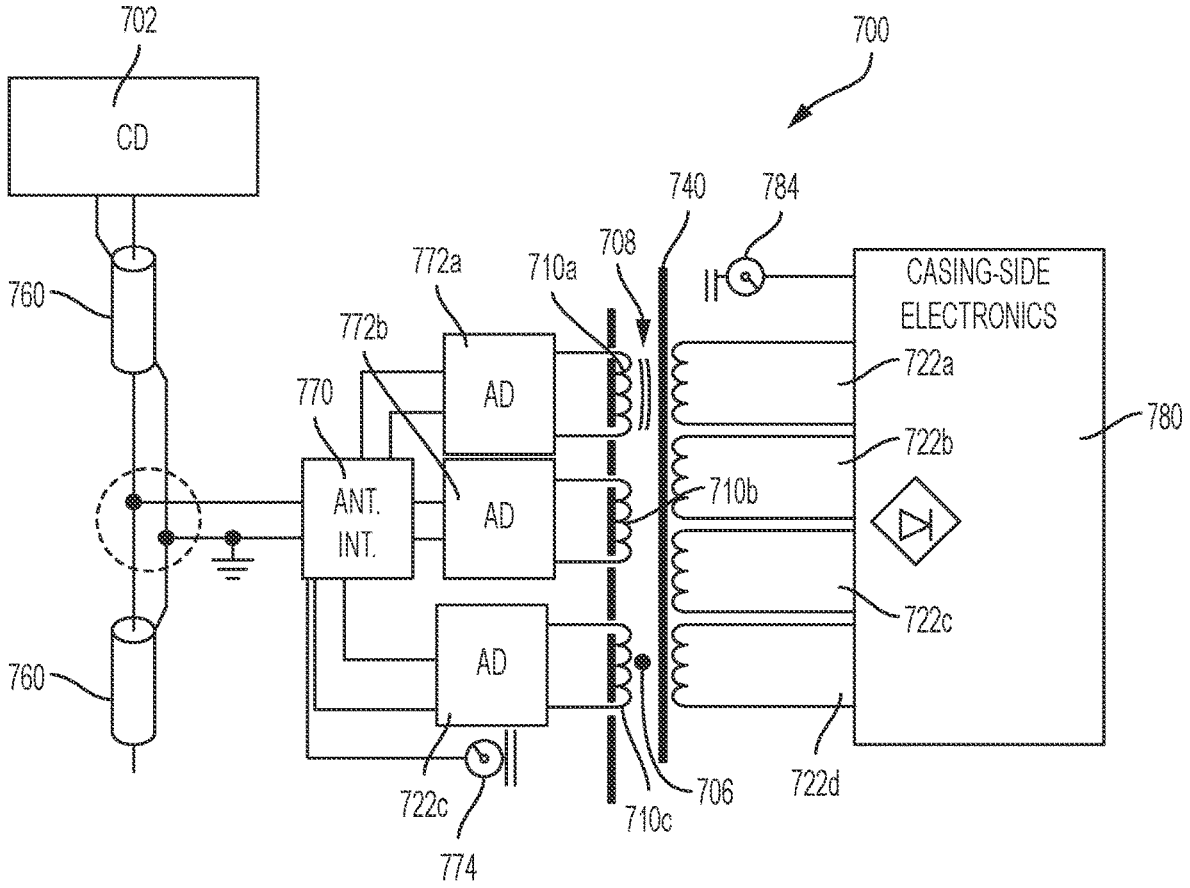
FIG. 7 is a schematic diagram of an example of an antenna system with multiple tubing-side antennas for maintaining communication with a casing-side antenna stack in a wellbore according to one aspect of the present disclosure.

FIG. 7 is a schematic diagram of an example of an antenna system 700 with multiple tubing-side antennas 710*a-c* coupled to a tubing string 704 and a casing-side sensor 784 coupled to a casing string 740. The antenna system 700 also includes a tubing-side antenna interface 770, tubing-side antenna drivers 772*a-c*, and a tubing-side sensor 774, which may be optional for obtaining measurements from within the casing string. The antenna system 700 can further include casing-side antennas 722*a-d*, casing-side electronics 780, a computing device 702, and a cable 760 that communicatively couples the computing device 702 to the tubing-side antenna interface 770.

Using multiple tubing-side antennas 710*a-c* can allow the antenna system 700 to maintain communication with the casing-side sensor 784 despite movement of the tubing string 704. Tubing-side antenna 710*c* can be positioned on the tubing string 704 at a distance from the tubing-side antenna 710*a* based on a length of the casing-side antenna stack that includes the casing-side antennas 722*a-d*. The tubing-side antenna 710*c* can be an alignment-extension tubing-side antenna such that if movement by the tubing string 704 causes the tubing-side antenna 710*a* to move out of a communication range of one of the casing-side antennas 722*a-d*, the tubing-side antenna 710*c* can move into a communication range of one of the casing-side antennas 722*a-d*.

In this example, tubing-side antennas 710*a-b* are within a communication range of one or more of the casing-side antennas 722*a-d*. An electromagnetic field 708 can be generated by tubing-side antenna 710*a* and transfer power, instructions, or both power and instructions to casing-side antenna 722*a* across gap 706 between the tubing string 704 and the casing string 740. The computing device 702 can transmit instructions to the tubing-side antenna interface 770 via cable 760. The tubing-side antenna interface 770 can be communicatively coupled to the tubing-side antenna driver 772*a* for causing the tubing-side antenna driver 772*a* to pass alternating current through conductive coil included in the tubing-side antenna 710*a* to generate the electromagnetic field 708. Current can be generated on a conductive coil included in casing-side antenna 722*a* and the current can be received by the casing-side electronics 780. In some examples, the current can be a modulated signal instructing the casing-side electronics 780 to cause the casing-side sensor 784 to take certain measurements. In additional or alternative examples, the current can be used to power the casing-side sensor 784 and the casing-side antenna 722*a* to cause data representing certain measurements to be transmitted back to the tubing-side antenna 710*a*. Tubing-side antenna 710*b* can provide a redundant communication path if an error occurs in tubing-side antenna 710*a*, casing-side antenna 722*a*, or their associated electronics.

Figure 8:
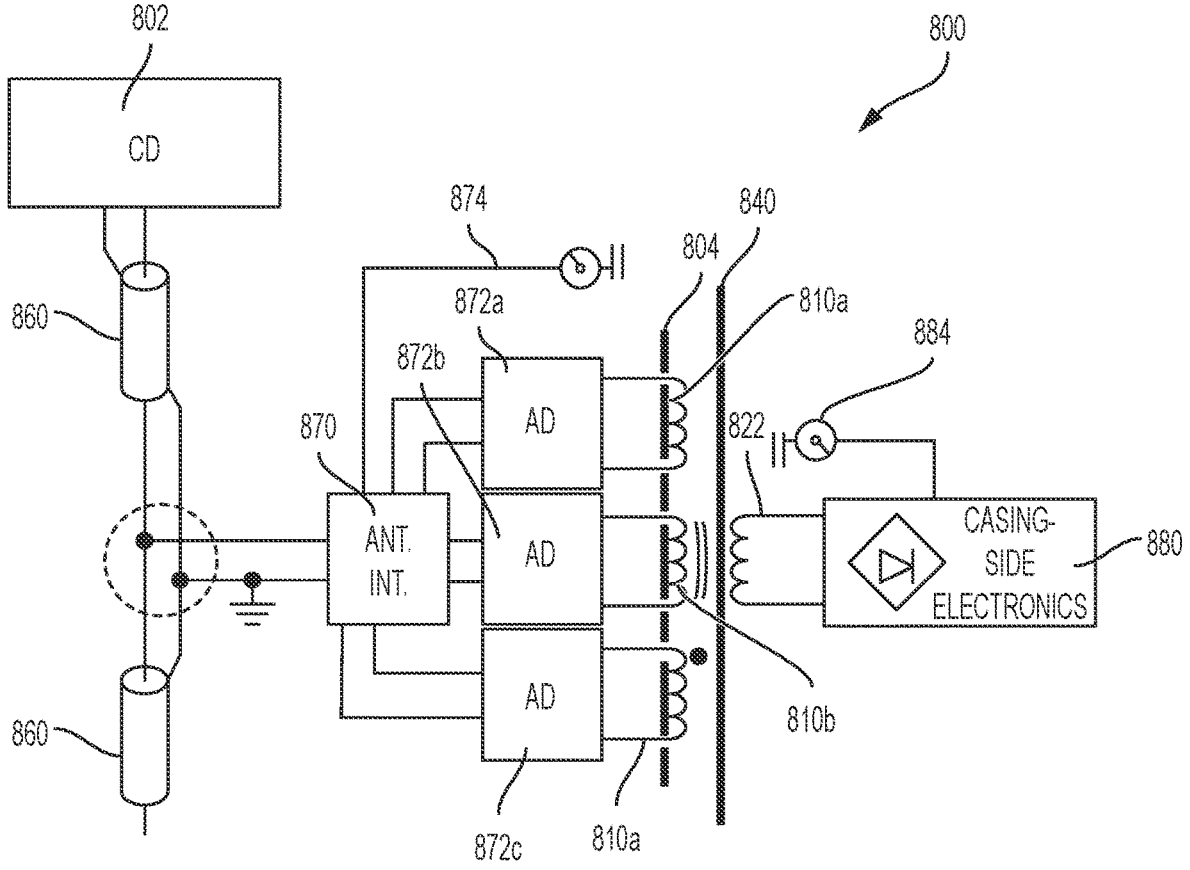
FIG. 8 is a schematic diagram of an example of an antenna system with multiple tubing-side antennas for maintaining communication with a single casing-side antenna in a wellbore according to one aspect of the present disclosure.

Although FIG. 7 depicts a casing-side antenna stack with multiple casing-side antennas 722*a-d*, other implementations are possible. For example, FIG. 8 is a schematic diagram of an example of an antenna system 800 with multiple tubing-side antennas 810*a-c* coupled to a tubing string 804 and a casing-side sensor 884 coupled to a casing string 840, along with a single casing-side antenna 822. The antenna system 800 can include similar components to the antenna system 700 in FIG. 7. The antenna system 800 can include a tubing-side antenna interface 870, tubing-side antenna drivers 872*a-c*, and a tubing-side sensor 874. The antenna system 800 can further include the casing-side antenna 822, casing-side electronics 880, a computing device 802, and a cable 860 that communicatively couples the computing device 802 to the tubing-side antenna interface 870.

In some examples, the antenna system 800 can be less expensive and involve fewer resources than the antenna system 700. The distance between tubing-side antennas in the antenna system 800 is smaller than the distance between alignment-extension tubing-side antennas in the antenna system 700 based on a length of the casing-side antenna in antenna system 800 being less than a length of the casing-side antenna stack in antenna system 700. Although more tubing-side antennas are used in antenna system 800 to offer the same alignment length as antenna system 700, tubing-side antennas 710*a-c*, 810*a-c* can have a smaller diameter than casing-side antennas 722*a-d*, 822 and are less expensive to manufacture.

Although the antenna systems 700, 800 in FIGS. 7-8 depict each tubing-side antenna 710*a-c*, 810*a-c* as communicatively coupled to one of the tubing-side antenna drivers 772*a-c*, 872*a-c*, other implementations are possible. For example, an antenna system can include a single tubing-side antenna driver in series with multiple tubing-side antennas for driving a current through the multiple tubing-side antennas. In some aspects, a tubing-side antenna driver and a tubing-side antenna interface can be included in a single tubing-side component.

Although FIGS. 7-8 depict antenna systems 700, 800 including multiple tubing-side antennas for maintaining communication in a wellbore 104 other implementations are possible. For example, an antenna system can include multiple casing-side antennas for maintaining communication with one or more tubing-side antennas. The multiple casing-side antennas can act as alignment-extension antennas and redundancy antennas to increase the alignment range and reliability of communication between the casing-side antennas stack and one or more tubing-side antennas in the wellbore.

In some aspects, maintaining communication with a casing-side sensor in a wellbore using multiple tubing-side antennas is provided according to one or more of the following examples:

Example #1: An assembly can include a tubing string having a first tubing-side antenna and a second tubing-side antenna. The tubing string can be positioned in a wellbore in which a casing string having a casing-side antenna coupled thereto is positioned. The tubing string can move with respect to the casing string from a first position to a second position in the wellbore in response to a force. The first tubing-side antenna can be coupled at a first location on the tubing string to communicatively couple to the casing-side antenna in the first position and to be out of a communication range with the casing-side antenna in the second position. The second tubing-side antenna can be coupled at a second location that is spaced a distance from the first location on the tubing string to communicatively couple to the casing-side antenna in the second position.

Example #2: The assembly of Example #1, can further feature the tubing string including a third tubing-side antenna coupled at a third location on the tubing string for communicatively coupling to the casing-side antenna in the first position or the second position. The third location can be between the first location and the second location.

Example #3: The assembly of Example #1, can further feature the casing string including a casing-side sensor and a casing-side antenna stack. The casing-side sensor can be coupled to the casing string for measuring characteristics of a subterranean formation through which the wellbore is formed. The casing-side antenna stack can include the casing-side antenna and can be communicatively coupled to the casing-side sensor. The distance between the first location and the second location can be less than or equal to a length of the casing-side antenna stack.

Example #4: The assembly of Example #3, can further feature the first tubing-side antenna and the second tubing-side antenna being communicatively coupled to a device at a surface of the wellbore via a cable to transmit information between the device and the casing-side sensor via the casing-side antenna stack and the first tubing-side antenna or the second tubing-side antenna.

Example #5: The assembly of Example #1, can further feature the first tubing-side antenna and the second tubing-side antenna each including a conductive wire coiled around the tubing string. The tubing string further including a driver for applying an alternating current through the conductive wire to generate an electromagnetic signal.

Example #6: The assembly of Example #1, can further feature the force being a result of changes in temperature, pressure, or fluid flow in the wellbore. The first location on the tubing string and the casing-side antenna can be in a plane extending radially from a center of the tubing string in response to the tubing string being at the first position. The second location on the tubing string and the casing-side antenna can be in a plane extending radially from a center of the tubing string in response to the tubing string being at the second position.

Example #7: The assembly of Example #1, can further feature the first tubing-side antenna and the second tubing-side antenna being communicatively coupled to the casing-side antenna to transmit power to the casing-side antenna and to communicate data with a casing-side sensor coupled to the casing-side antenna.

Example #8: An antenna system can include a first tubing-side antenna and a second tubing-side antenna. The first tubing-side antenna can be positioned on a tubing string that can move from a first position to a second position with respect to a casing-side antenna on a casing string in a wellbore. The first tubing-side antenna can be positioned at a first location on the tubing string for communicatively coupling to the casing-side antenna in the first position and for being out of range from communicating with the casing-side antenna in the second position. The second tubing-side antenna can be positioned at a second location on the tubing string that is spaced a distance from the first location on the tubing string for communicatively coupling to the casing-side antenna in the second position.

Example #9: The antenna system of Example #8, can further include a third tubing-side antenna that can be positioned at a third location on the tubing string that is between the first location and the second location for communicatively coupling to the casing-side antenna in the first position or the second position.

Example #10: The antenna system of Example #8, can further feature the casing-side antenna being one casing-side antenna of multiple casing-side antennas. The antenna system can further include a casing-side antenna stack that includes the casing-side antennas coupled thereto. The casing-side antenna stack can be communicatively coupled to a casing-side sensor for measuring characteristics of a subterranean formation through which the wellbore is formed. The distance between the first location and the second location can be less than or equal to a length of the casing-side antenna stack.

Example #11: The antenna system of Example #10, can further feature the first tubing-side antenna and the second tubing-side antenna being communicatively coupled to a device at a surface of the wellbore via a cable to transmit information between the device and the casing-side sensor via the casing-side antenna stack and the first tubing-side antenna or the second tubing-side antenna.

Example #12: The antenna system of Example #8, can further feature the first tubing-side antenna and the second tubing-side antenna each including a conductive wire coiled around the tubing string for generating an electromagnetic signal in response to a driver applying an alternating current through the conductive wire.

Example #13: The antenna system of Example #8, can further feature the tubing string moving in response to a force that is a result of changes in temperature, pressure, or fluid flow in the wellbore. The first location on the tubing string and the casing-side antenna can be in a plane extending radially from a center of the tubing string in response to the tubing string being at the first position. The second location on the tubing string and the casing-side antenna being can be in a plane extending radially from a center of the tubing string in response to the tubing string being at the second position.

Example #14: The antenna system of Example #8, can further feature the first tubing-side antenna and the second tubing-side antenna being communicatively coupled to the casing-side antenna to transmit power to the casing-side antenna and receive data from a casing-side sensor coupled to the casing-side antenna.

Example #15: A method can include communicatively coupling a first tubing-side antenna to a casing-side antenna in response to a tubing string being positioned at a first position in a wellbore in which a casing string having the casing-side antenna coupled thereto is positioned. The tubing string can include the first tubing-side antenna coupled at a first location on the tubing string and a second tubing-side antenna coupled at a second location that is spaced a distance from the first location on the tubing string. The method can further include communicatively decoupling the first tubing-side antenna to the casing-side antenna in response to the tubing string being moved to a second position by a force such that the first tubing-side antenna is out of communication range with the casing-side antenna. The method can further include communicatively coupling the second tubing-side antenna to the casing-side antenna in response to the tubing string being at the second position.

Example #16: The method of Example #15, can further include communicatively coupling a third tubing-side antenna to the casing-side antenna in response to the tubing string being in the first position. The third tubing-side antenna can be coupled at a third location on the tubing string that is between the first location and the second location. The third tubing-side antenna can remain within communication range of the casing-side antenna in response to the tubing string being moved to the second position. The third tubing-side antenna can communicate with the casing-side antenna in response to the first tubing-side antenna failing to communicate with the casing-side antenna when in the first position or the second tubing-side antenna failing to communicate with the casing-side antenna when in the second position.

Example #17: The method of Example #15, can further feature the casing-side antenna being one casing-side antenna of multiple casing-side antennas. The method can further include measuring, by a casing-side sensor, characteristics of a subterranean formation through which the wellbore is formed. The method can further include transmitting, by a casing-side antenna stack having the multiple casing-side antennas, a signal including the characteristics of the subterranean formation. The method can further include receiving, by the first tubing-side antenna or the second tubing-side antenna, the signal transmitted by the casing-side antenna stack. The distance between the first location and the second location can be less than or equal to a length of the casing-side antenna stack.

Example #18: The method of Example #17, can further include transmitting, by the first tubing-side antenna or the second tubing-side antenna, data representing the characteristics of the subterranean formation to a device at a surface of the wellbore via a cable positioned in the wellbore.

Example #19: The method of Example #17, can further feature the first tubing-side antenna and the second tubing-side antenna each including a conductive wire coiled around the tubing string. Receiving the signal transmitted by the casing-side antenna stack can include generating a current on the conductive wire associated with the first tubing-side antenna or the second tubing-side antenna.

Example #20: The method of Example #15, can further feature the first location of the tubing string and the casing-side antenna being in a plane extending radially from a center of the tubing string in response to the tubing string being at the first position in the wellbore. The force can be a result of changes in temperature, pressure, or fluid flow in the tubing string.

Example #21: An assembly can include a casing string having a first casing-side antenna and a second casing-side antenna. The casing string can be positioned in a wellbore in which a tubing string having a tubing-side antenna coupled thereto is positioned. The tubing string can move with respect to the casing string from a first position to a second position in the wellbore in response to a force. The first casing-side antenna can be coupled at a first location on the casing string to communicatively couple to the tubing-side antenna in the first position and to be out of a communication range with the tubing-side antenna in the second position. The second casing-side antenna can be coupled at a second location that is spaced a distance from the first location on the casing string to communicatively couple to the tubing-side antenna in the second position.

Example #22: The assembly of Example #21, can further feature the casing string including a third casing-side antenna coupled at a third location on the casing string for communicatively coupling to the tubing-side antenna in the first position or the second position. The third location can be between the first location and the second location.

Example #23: The assembly of Example #21, can further feature the casing string including a casing-side sensor and a casing-side antenna stack. The casing-side sensor can be coupled to the casing string for measuring characteristics of a subterranean formation through which the wellbore is formed. The casing-side antenna stack can include the first casing-side antenna and the second casing-side antenna and can be communicatively coupled to the casing-side sensor. The distance between the first location and the second location can be less than or equal to a length of the tubing-side antenna stack.

Example #24: The assembly of Example #23, can further feature the tubing-side antenna being communicatively coupled to a device at a surface of the wellbore via a cable to transmit information between the device and the casing-side sensor via the tubing-side antenna and the first casing-side antenna or the second casing-side antenna.

Example #25: The assembly of Example #21, can further feature the first casing-side antenna and the second casing-side antenna each including a conductive wire coiled around the casing string. The tubing string further including a driver for applying an alternating current through the conductive wire to generate an electromagnetic signal.

Example #26: The assembly of Example #21, can further feature the force being a result of changes in temperature, pressure, or fluid flow in the wellbore. The first location on the casing string and the tubing-side antenna can be in a plane extending radially from a center of the casing string in response to the tubing string being at the first position. The second location on the casing string and the tubing-side antenna can be in a plane extending radially from a center of the casing string in response to the tubing string being at the second position.

Example #27: The assembly of Example #21, can further feature the first casing-side antenna and the second casing-side antenna being communicatively coupled to the tubing-side antenna to receive power from the tubing-side antenna and to communicate data with a casing-side sensor.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. An assembly comprising:

a production tubing string positionable in a wellbore in which a casing string comprising a casing-side antenna is installed, the production tubing string being movable with respect to the casing string from a first position to a second position in the wellbore in response to a force, the production tubing string comprising:

a first tubing-side antenna extending around the production tubing string and coupled at a first location on the production tubing string to communicatively couple to the casing-side antenna in the first position and to be out of a communication range with the casing-side antenna in the second position; and a second tubing-side antenna extending around the production tubing string and coupled at a second location that is spaced a distance from the first location on the production tubing string to communicatively couple to the casing-side antenna in the second position; and a cable communicatively coupleable to the first tubing-side antenna and the second tubing-side antenna to transmit signals to a surface of the wellbore, wherein the signals represent data from a casing-side sensor positionable to measure characteristics of a subterranean formation through which the wellbore is formed, and wherein the data is receivable by the first tubing-side antenna and the second-tubing side antenna from the casing-side antenna.

2. The assembly of claim 1, wherein the production tubing string further comprises a third tubing-side antenna coupled at a third location on the production tubing string for communicatively coupling to the casing-side antenna in the first position or the second position, the third location being between the first location and the second location.

3. The assembly of claim 1, wherein the casing string includes:

the casing-side sensor coupled to the casing string for measuring the characteristics of the subterranean formation through which the wellbore is formed; and a casing-side antenna stack that includes the casing-side antenna coupled to the casing-side antenna stack, the casing-side antenna stack being communicatively coupled to the casing-side sensor, wherein the distance between the first location and the second location is less than or equal to a length of the casing-side antenna stack.

4. The assembly of claim 3, wherein the first tubing-side antenna and the second tubing-side antenna are communicatively coupleable to a device at the surface of the wellbore via the cable to transmit information between the device and the casing-side sensor via the casing-side antenna stack and the first tubing-side antenna or the second tubing-side antenna.

5. The assembly of claim 1, wherein the first tubing-side antenna and the second tubing-side antenna each comprise a conductive wire coiled around the production tubing string, the production tubing string further comprising a driver for applying an alternating current through the conductive wire to generate an electromagnetic signal.

6. The assembly of claim 1, wherein the force is a result of changes in temperature, pressure, or fluid flow in the wellbore, the first location on the production tubing string and the casing-side antenna in a plane extending radially from a center of the production tubing string in response to the production tubing string being at the first position, and the second location on the production tubing string and the casing-side antenna in a plane extending radially from a center of the production tubing string in response to the production tubing string being at the second position.

7. The assembly of claim 1, wherein the first tubing-side antenna and the second tubing-side antenna are communicatively coupleable to the casing-side antenna to transmit power to the casing-side antenna and to communicate data with a casing-side sensor coupled to the casing-side antenna.

8. An assembly comprising:

a casing string installable in a wellbore to receive a production tubing string comprising a first tubing-side antenna and a second tubing-side antenna, the production tubing string being movable with respect to the casing string from a first position to a second position in the wellbore in response to a force, the casing string comprising:

a first casing-side antenna coupled at a first location on the casing string to communicatively couple to the first tubing-side antenna in the first position and to be out of a communication range with the first tubing-side antenna in the second position; and a second casing-side antenna coupled at a second location that is spaced a distance from the first location on the casing string to communicatively couple to the first tubing-side antenna in the second position;

the production tubing string comprising:

the first tubing-side antenna extending around the production tubing string and coupled at a first location on the production tubing string to communicatively couple to the first casing-side antenna in the first position and to be out of a communication range with the first casing-side antenna in the second position; and a second tubing-side antenna extending around the production tubing string and coupled at a second location that is spaced a distance from the first location on the production tubing string to communicatively couple to the first casing-side antenna in the second position; and a cable communicatively coupleable to the first tubing-side antenna and the second tubing-side antenna to transmit signals to a surface of the wellbore, wherein the signals represent data from a casing-side sensor positionable to measure characteristics of a subterranean formation through which the wellbore is formed, and wherein the data is receivable by the first tubing-side antenna and the second-tubing side antenna from the casing-side antenna.

9. The assembly of claim 8, wherein the casing string further comprises a third casing-side antenna coupled at a third location on the casing string for communicatively coupling to the first tubing-side antenna in the first position or the second position, the third location being between the first location and the second location.

10. The assembly of claim 8, wherein the casing string includes:

the casing-side sensor coupled to the casing string for measuring the characteristics of the subterranean formation through which the wellbore is formed; and a casing-side antenna stack that includes the first casing-side antenna and the second casing-side antenna coupled to the casing-side antenna stack, the casing-side antenna stack being communicatively coupled to the casing-side sensor, wherein the distance between the first location and the second location is less than or equal to a length of the tubing-side antenna.

11. The assembly of claim 10, wherein the first tubing-side antenna and the second tubing-side antenna are communicatively coupleable to a device at the surface of the wellbore via the cable to transmit information between the device and the casing-side sensor via the first tubing-side antenna or the second tubing-side antenna and the first casing-side antenna or the second casing-side antenna.

12. The assembly of claim 8, wherein the first casing-side antenna and the second casing-side antenna each comprise a conductive wire coiled around the casing string for generating an alternating current in response to an electromagnetic signal.

13. The assembly of claim 8, wherein the force is a result of changes in temperature, pressure, or fluid flow in the wellbore, the first location on the casing string and the tubing-side antenna in a plane extending radially from a center of the casing string in response to the production tubing string being at the first position, and the second location on the casing string and the tubing-side antenna in a plane extending radially from a center of the casing string in response to the production tubing string being at the second position.

14. The assembly of claim 8, wherein the first casing-side antenna and the second casing-side antenna are communicatively coupleable to the tubing-side antenna to receive power from the tubing-side antenna and to communicate data with a casing-side sensor coupled to the first casing-side antenna and the second casing-side antenna.

15. A method comprising:

communicatively coupling a first tubing-side antenna to a casing-side antenna in response to a production tubing string being positioned at a first position in a wellbore in which a casing string comprising the casing-side antenna is installed, the production tubing string comprising the first tubing-side antenna extending around the production tubing string and coupled at a first location on the production tubing string and a second tubing-side antenna extending around the production tubing string and coupled at a second location that is spaced a distance from the first location on the production tubing string;

communicatively decoupling the first tubing-side antenna from the casing-side antenna in response to the production tubing string being moved to a second position by a force such that the first tubing-side antenna is out of communication range with the casing-side antenna;

communicatively coupling the second tubing-side antenna to the casing-side antenna in response to the production tubing string being at the second position; and transmitting, by the first tubing-side antenna or the second tubing-side antenna, data representing characteristics of a subterranean formation through which the wellbore is formed to a surface of the wellbore via a cable that is communicatively coupled to the first tubing-side antenna and the second tubing-side antenna, wherein the data is collected from a casing-side sensor and is received by the first tubing-side antenna, the second-tubing side antenna, or both from the casing-side antenna.

16. The method of claim 15, further comprising communicatively coupling a third tubing-side antenna to the casing-side antenna in response to the production tubing string being in the first position, the third tubing-side antenna being coupled at a third location on the production tubing string that is between the first location and the second location, wherein the third tubing-side antenna remains within communication range of the casing-side antenna in response to the production tubing string being moved to the second position, wherein the third tubing-side antenna communicates with the casing-side antenna in response to the first tubing-side antenna failing to communicate with the casing-side antenna when in the first position or the second tubing-side antenna failing to communicate with the casing-side antenna when in the second position.

17. The method of claim 15, wherein the casing-side antenna is one casing-side antenna of a plurality of casing-side antennas, the method further comprising:

measuring, by the casing-side sensor, the characteristics of the subterranean formation through which the wellbore is formed;

transmitting, by a casing-side antenna stack having the plurality of casing-side antennas, a signal including the characteristics of the subterranean formation; and receiving, by the first tubing-side antenna or the second tubing-side antenna, the signal transmitted by the casing-side antenna stack, wherein the distance between the first location and the second location is less than or equal to a length of the casing-side antenna stack.

18. The method of claim 17, wherein the operation of transmitting the data comprises transmitting the data to a device at the surface of the wellbore via the cable positioned in the wellbore.

19. The method of claim 17, wherein the first tubing-side antenna and the second tubing-side antenna each include a conductive wire coiled around the production tubing string, wherein receiving the signal transmitted by the casing-side antenna stack comprises generating a current on the conductive wire associated with the first tubing-side antenna or the second tubing-side antenna.

20. The method of claim 15, wherein the first location of the production tubing string and the casing-side antenna being in a plane extending radially from a center of the production tubing string in response to the tubing string being at the first position in the wellbore, wherein the force is a result of changes in temperature, pressure, or fluid flow in the tubing string.

* * * * *